US007223310B2

(12) United States Patent
Inoue

(10) Patent No.: US 7,223,310 B2
(45) Date of Patent: May 29, 2007

(54) SOFT MAGNETIC CO-BASED METALLIC GLASS ALLOY

(75) Inventor: Akihisa Inoue, Miyagi (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 0 days.

(21) Appl. No.: 10/510,642

(22) PCT Filed: Apr. 7, 2003

(86) PCT No.: PCT/JP03/04417

§ 371 (c)(1),
(2), (4) Date: Apr. 7, 2005

(87) PCT Pub. No.: WO03/085151

PCT Pub. Date: Oct. 16, 2003

(65) Prior Publication Data

US 2005/0178476 A1 Aug. 18, 2005

(30) Foreign Application Priority Data

Apr. 10, 2002 (JP) ..... 2002-108352

(51) Int. Cl.
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 5,976,274 A * 11/1999 Inoue et al. ..... 148/304
6,077,367 A * 6/2000 Mizushima et al. ..... 148/561
6,284,061 B1 * 9/2001 Inoue et al. ..... 148/304
6,296,681 B1 * 10/2001 Mizushima et al. ..... 75/230
2001/0031373 A1 10/2001 Sawa et al.

FOREIGN PATENT DOCUMENTS

| | | |
|---|---|---|
| JP | 04-143239 | 5/1992 |
| JP | 07-183113 | 7/1995 |
| JP | 10-324939 | 12/1998 |

* cited by examiner

*Primary Examiner*—John P. Sheehan
(74) *Attorney, Agent, or Firm*—Westerman, Hattori, Daniels & Adrian, LLP.

(57) ABSTRACT

Disclosed is a soft magnetic Co-based metallic glass alloy with high glass forming ability, which has a supercooled-liquid temperature interval ($\Delta T_\chi$) of 40 K or more, a reduced glass-transition temperature ($T_g/T_m$) of 0.59 and a low coercive force of 2.0 A/m or less. The metallic glass alloy is represented by the following composition formula: $[Co_{1-n-(a+b)}Fe_nB_aSi_b]_{100-\chi}M_\chi$, wherein each of a, b and n represents an atomic ratio satisfying the following relations: $0.1 \leqq a \leqq 0.17$; $0.06 \leqq b \leqq 0.15$; $0.18 \leqq a+b \leqq 0.3$; and $0 \leqq n \leqq 0.08$, M representing one or more elements selected from the group consisting of Zr, Nb, Ta, Hf, Mo, Ti, V, Cr, Pd and W, and $\chi$ satisfying the following relation: 3 atomic $\% \leqq \chi \leqq 10$ atomic %. The present invention overcomes restrictions in preparing a metallic glass bar with a thickness of 1 mm or more from conventional Co—Fe—B—Si-based metallic glasses due to their poor glass forming ability, and provides an excellent Co—Fe—B—Si-based metallic glass allowing the formation of bulk metallic glass, which serves as a key technology for achieving a broader application fields of metallic glass products.

2 Claims, 4 Drawing Sheets

SOFT MAGNETIC CO-BASED METALLIC GLASS ALLOY

TECHNICAL FIELD

The present invention relates to a soft magnetic Co-based metallic glass alloy having low coercive force and high glass forming ability or ability allowing a larger-size metal cast consisting of a glass phase to be produced from its liquid phase through a cooling/solidification process in a supercooled liquid state.

BACKGROUND ART

As for amorphous alloys, there have heretofore been known Fe—P—C-based alloy which was first produced in the 1960s, (Fe, Co, Ni)—P—B-based alloy, (Fe, Co, Ni)—Si—B-based alloy, (Fe, Co, Ni)—(Zr, Hf, Nb)-based alloy and (Fe, Co, Ni)—(Zr, Hf, Nb)—B-based alloy which were produced in the 1970s.

All of the above alloys are essentially subjected to a rapid solidification process at a cooling rate of $10^4$ K/s or more, and an obtained sample is a thin strip having a thickness of 200 μm or less. Between 1988 and 2001, various metallic glass alloys exhibiting high glass forming ability, which have a composition, such as Ln—Al—TM, Mg—Ln—TM, Zr—Al—TM, Pd—Cu—Ni—P, (Fe, Co, Ni)—(Zr, Hf, Nb)—B, Fe—(Al, Ga)—P—B—C, Fe—(Nb, Cr, Mo)—(Al, Ga)—P—B—C, Fe—(Cr, Mo)—Ga—P—B—C, Fe—Co—Ga—P—B—C, Fe—Ga—P—B—C or Fe—Ga—P—B—C—Si (wherein Ln is a rare-earth element, and TM is a transition metal), were discovered. These alloys can be formed as a metallic glass bar having a diameter or thickness of 1 mm or more.

The inventor previously filed a patent application concerning a soft magnetic metallic glass alloy of Co—(Fe, Ni)—(Ti, Zr, Nb, Ta, Hf, Mo, W)—(Cr, Mn, Ru, Rh, Pd, Os, Ir, Pt, Al, Ga, Si, Ge, C, P)—B, which has a supercooled-liquid temperature interval ($\Delta T_\chi$) of 20 to 45 K and a coercive force (Hc) of 2 to 9 A/m (Japanese Patent Laid-Open Publication No. 10-324939).

DISCLOSURE OF INVENTION

The inventor has hitherto found out several Co-based soft magnetic metallic glass alloys. However, these metallic glass alloys are formed through a single-roll process in the form of a thin strip (or film, ribbon) having a relatively high coercive force. In view of practical applications, it is desired to provide a soft magnetic metallic glass alloy capable of being formed as a bulk metallic glass with a lower coercive force.

Through researches on various alloy compositions with a view to solving the above problem, the inventor found a soft magnetic Co—B—Si-based metallic glass alloy composition which exhibits clear glass transition and wide supercooled liquid region and has higher glass forming ability.

Specifically, the present invention provides a soft magnetic Co-based metallic glass alloy with high glass forming ability, which has a supercooled-liquid temperature interval ($\Delta T_\chi$) of 40 K or more, a reduced glass-transition temperature ($T_g/T_m$) of 0.59 or more and a coercive force (Hc) of 2.0 A/m or less. The metallic glass alloy is represented by the following composition formula: $[Co_{1-n-(a+b)}Fe_nB_aSi_b]_{100-\chi}M_\chi$, wherein each of a, b and n represents an atomic ratio satisfying the following relations: $0.1 \leqq a \leqq 0.17$; $0.06 \leqq b \leqq 0.15$; $0.18 \leqq a+b \leqq 0.3$; and $0 \leqq n \leqq 0.08$, M representing one or more elements selected from the group consisting of Zr, Nb, Ta, Hf, Mo, Ti, V, Cr, Pd and W, and $\chi$ satisfying the following relation: 3 atomic % $\leqq \chi \leqq$ 10 atomic %.

In a metallic glass prepared using the alloy with the above composition through a single-roll rapid liquid cooling process in the form of a thin strip having a thickness of 0.2 mm or more, a supercooled-liquid temperature interval (or the temperature interval of a supercooled liquid region) ($\Delta T_\chi$), which is expressed by the following formula: $\Delta T_\chi = T_\chi - T_g$ (wherein $T_\chi$ is a crystallization temperature, and $T_g$ is a glass transition (vitrification) temperature), is 40 K or more, and a reduced glass-transition temperature ($T_g/T_m$) is 0.59 or more.

During the course of preparing a metallic glass using the alloy represented by the above composition formula through a cupper-mold casting process, heat generation caused by significant glass transition and crystallization is observed in a thermal analysis. A critical thickness or diameter in glass formation is 1.5 mm. This proves that a metallic glass can be prepared through the cupper-mold casting process. In addition, this glass alloy exhibits excellent soft magnetic characteristics, such as a low coercive force (Hc) of 2.0 A/m or less, which are significantly useful as transformers or magnetometric sensors.

In the above alloy composition of the present invention, a primary component or Co is an element playing a role in creating magnetism. This roll is critical to obtain high saturation magnetization and excellent soft magnetic characteristics. The alloy composition includes about 56 to 80 atomic % of Co.

In the above alloy composition of the present invention, the metal element Fe is added in an amount of about 8 atomic % or less, preferably in the range of 2 to 6 atomic %, to effectively reduce a coercive force to 1.5 A/m or less.

In the above alloy composition of the present invention, the metalloid elements B and Si play a role in forming an amorphous phase. This role is critical to obtain a stable amorphous structure. The atomic ratio of Co—Fe—B—Si is set such that the total of n+a+b is in the range of 0.18 to and 0.38, and the remainder is Co. If the total of n+a+b is deviated from this range, it will be difficult to form an amorphous phase. It is required to contain both B and Si. If either one of B and Si is deviated from the above composition range, the glass forming ability will be deteriorated to cause difficulties in forming a bulk metallic glass.

In the above alloy composition of the present invention, the addition of the element M is effective to provide enhanced glass forming ability. In the alloy composition of the present invention, the element M is added in the range of 3 atomic % to 10 atomic %. If the element M is deviated from this range and less than 3 atomic %, the supercooled-liquid temperature interval ($\Delta T_\chi$) will undesirably disappear. If the element M is greater than 10 atomic %, the saturation magnetization will be undesirably reduced.

The alloy with the above composition of the present invention may further contain 3 atomic % or less of one or more elements selected from the group consisting of P, C, Ga and Ge. The addition of the one or more elements allows a coercive force to have a reduced value ranging from 1.5 A/m to 0.75 A/m, or provides enhanced soft magnetic characteristics. On the other hand, if the content of the one or more elements becomes greater than 3 atomic %, the resulting reduced content of Co will cause a decrease in saturation magnetization. Thus, the content of the one or more elements is set at 3 atomic % or less.

In the above alloy composition of the present invention, any deviation from the composition ranges defined as above causes deteriorated glass forming ability to create/grow crystals during the process of solidifying liquid metal so as to form a mixed structure of a glass phase and a crystal phase. If the deviation from the composition range becomes larger, an obtained structure will have only a crystal phase without any glass phase.

The alloy of the present invention has high glass forming ability. Thus, the alloy can be formed as a metallic glass round bar with a diameter of 1.5 mm through a casting process in a supercooled liquid state using a copper-mold having a low cooling rate. Further, at the same cooling rate, the alloy can be formed as a metallic glass thin wire with a maximum diameter of 0.4 mm through an in-rotating-water spinning process or a metallic glass powder with a maximum particle diameter of 0.5 mm through an atomization process.

BEST MODE FOR CARRYING OUT THE INVENTION

INVENTIVE EXAMPLES 1 TO 10 & COMPARATIVE EXAMPLES 1 TO 7

With reference to the drawings, the present invention will now be specifically described in connection with examples.

Figure 5:
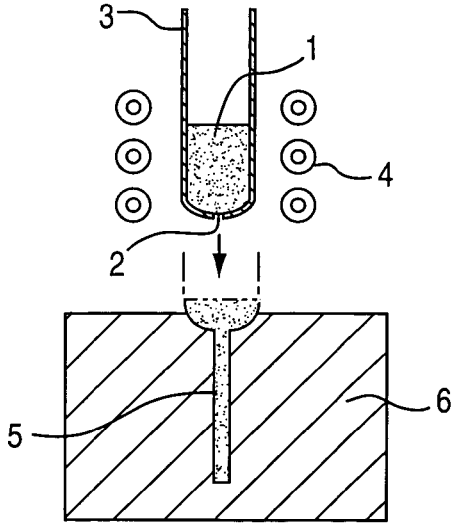
FIG. 5 is a schematic side view of an apparatus for use in preparing a cast bar serving as an alloy sample through a metal-mold casting process.

FIG. 5 is a schematic side view of an apparatus used in preparing an alloy sample with a diameter of 0.5 to 2 mm through a metal-mold casting process. A molten alloy 1 having a given composition was first prepared through an arc melting process. The alloy 1 was inserted into a silica tube 3 having a front end formed with a small opening (diameter: 0.5 mm) 2, and heated/melted using a high-frequency coil 4. Then, the silica tube 3 was disposed immediately above a copper mold 6 formed with a vertical hole 5 having a diameter of 0.5 to 2 mm to serve as a casting space, and a given pressure (1.0 Kg/cm$^2$) of argon gas was applied onto the molten metal 1 in the silica tube 3 to inject the molten metal 1 from the small opening 2 of the silica tube 3 into the hole 5 of the copper mold 6. The injected molten metal was left uncontrolled and solidified to obtain a cast bar having a diameter of 0.5 mm and a length of 50 mm.

Table 1 shows the respective alloy compositions of Inventive Examples 1 to 10 and Comparative Examples 1 to 7, and the respective glass transition temperatures ($T_g$) and crystallization temperatures ($T_\chi$) of Inventive Examples 1 to 10 measured using a differential scanning calorimeter. Further, the generated heat value of a sample due to crystallization was measured using a differential scanning calorimeter, and compared with that of a completely vitrified thin strip prepared through a single-roll rapid liquid cooling process to evaluate the volume fraction of a glass phase (Vf-amo.) contained in the sample.

Table 1 also shows the respective saturation magnetizations (Is) and coercive forces (Hc) of Inventive Examples 1 to 10 measured using a vibrating-sample magnetometer and an I-H loop tracer. Further, the vitrification in each of the cast bars of Inventive Examples 1 to 10 and Comparative Examples 1 to 7 was checked through X-ray diffraction analysis, and the sample sections were observed by an optical microscope.

In Inventive Examples 1 to 10, the supercooled-liquid temperature interval ($\Delta T_\chi$) expressed by the following formula: $\Delta T_\chi = T_\chi - T_g$ (wherein $T_\chi$ is a crystallization temperature, and $T_g$ is a glass transition temperature) was 40 K or more, and the volume fraction ($V_{f\text{-}amo.}$) of a glass phase was 100% in the form of a cast bar with a diameter of 1 to 1.5 mm.

In contrast, Comparative Examples 1 and 2 which contain the element M in an amount of 3 atomic % or less or contains no element M were crystalline in the form of a cast bar with a diameter of 0.5 mm. While Comparative Example 3 contains Nb as the element M, the content of Nb is 11 atomic % which is deviated from the alloy composition range of the present invention. As a result, it was crystalline in the form of a cast bar with a diameter of 0.5 mm. While Comparative Examples 4 to 7 contain the element M in the range of 1 to 10 atomic %, no Si or B is contained therein or the content of Si or B is deviated from the range of "a" or "b" in the composition formula. Thus, they were crystalline in the form of a cast bar with a diameter of 0.5 mm.

TABLE 1

| | Alloy Composition | Diameter (mm) | $T_g$ (K) | $T_x$ (k) | $T_x - T_g$ (K) | $T_g/T_m$ | $V_{f\text{-amo.}}$ | Is (T) | Hc (A/m) |
|---|---|---|---|---|---|---|---|---|---|
| Inventive Example 1 | $(Co_{0.75}B_{0.15}Si_{0.10})_{96}Nb_4$ | 1.0 | 810 | 850 | 40 | 0.60 | 100 | 0.61 | 1.8 |
| Inventive Example 2 | $(Co_{0.705}Fe_{0.045}B_{0.15}Si_{0.10})_{96}Nb_4$ | 1.0 | 820 | 862 | 42 | 0.61 | 100 | 0.60 | 1.5 |
| Inventive Example 3 | $(Co_{0.705}Fe_{0.045}B_{0.15}Si_{0.10})_{94}Nb_6$ | 1.5 | 850 | 890 | 40 | 0.63 | 100 | 0.42 | 1.2 |
| Inventive Example 4 | $(Co_{0.705}Fe_{0.045}B_{0.15}Si_{0.10})_{92}Nb_8$ | 1.5 | 875 | 915 | 40 | 0.64 | 100 | 0.38 | 1.0 |
| Inventive Example 5 | $(Co_{0.705}Fe_{0.045}B_{0.15}Si_{0.10})_{96}Zr_4$ | 1.0 | 800 | 845 | 45 | 0.59 | 100 | 0.70 | 1.5 |
| Inventive Example 6 | $(Co_{0.705}Fe_{0.045}B_{0.15}Si_{0.10})_{94}Zr_6$ | 1.5 | 815 | 865 | 50 | 0.60 | 100 | 0.64 | 1.0 |
| Inventive Example 7 | $(Co_{0.705}Fe_{0.045}B_{0.15}Si_{0.10})_{96}Hf_4$ | 0.5 | 820 | 865 | 45 | 0.59 | 100 | 0.60 | 1.5 |
| Inventive Example 8 | $(Co_{0.705}Fe_{0.045}B_{0.15}Si_{0.10})_{94}Hf_6$ | 1.0 | 825 | 875 | 50 | 0.60 | 100 | 0.75 | 1.2 |
| Inventive Example 9 | $(Co_{0.705}Fe_{0.045}B_{0.15}Si_{0.10})_{96}Ta_4$ | 0.5 | 830 | 875 | 45 | 0.59 | 100 | 0.58 | 1.4 |
| Inventive Example 10 | $(Co_{0.70}Fe_{0.04}Ga_{0.03}B_{0.14}Si_{0.09})_{96}Nb_4$ | 1.5 | 815 | 870 | 55 | 0.60 | 100 | 0.59 | 0.75 |

TABLE 1-continued

| | Alloy Composition | Diameter (mm) | $T_g$ (K) | $T_x$ (k) | $T_x - T_g$ (K) | $T_g/T_m$ | $V_{f\text{-amo.}}$ | Is (T) | Hc (A/m) |
|---|---|---|---|---|---|---|---|---|---|
| Comparative Example 1 | $Co_{70.5}Fe_{4.5}B_{15}Si_{10}$ | 0.5 | | | | crystalline | | | |
| Comparative Example 2 | $(Co_{0.705}Fe_{0.045}B_{0.15}Si_{0.10})_{98}Nb_2$ | 0.5 | | | | crystalline | | | |
| Comparative Example 3 | $(Co_{0.705}Fe_{0.045}B_{0.15}Si_{0.10})_{89}Nb_{11}$ | 0.5 | | | | crystalline | | | |
| Comparative Example 4 | $(Co_{0.8}B_{0.2})_{96}Nb_4$ | 0.5 | | | | crystalline | | | |
| Comparative Example 5 | $(Co_{0.8}Si_{0.2})_{96}Nb_4$ | 0.5 | | | | crystalline | | | |
| Comparative Example 6 | $(Co_{0.7}B_{0.2}Si_{0.1})_{96}Nb_4$ | 0.5 | | | | crystalline | | | |
| Comparative Example 7 | $(Co_{0.7}B_{0.1}Si_{0.2})_{96}Nb_4$ | 0.5 | | | | crystalline | | | |

Figure 1:
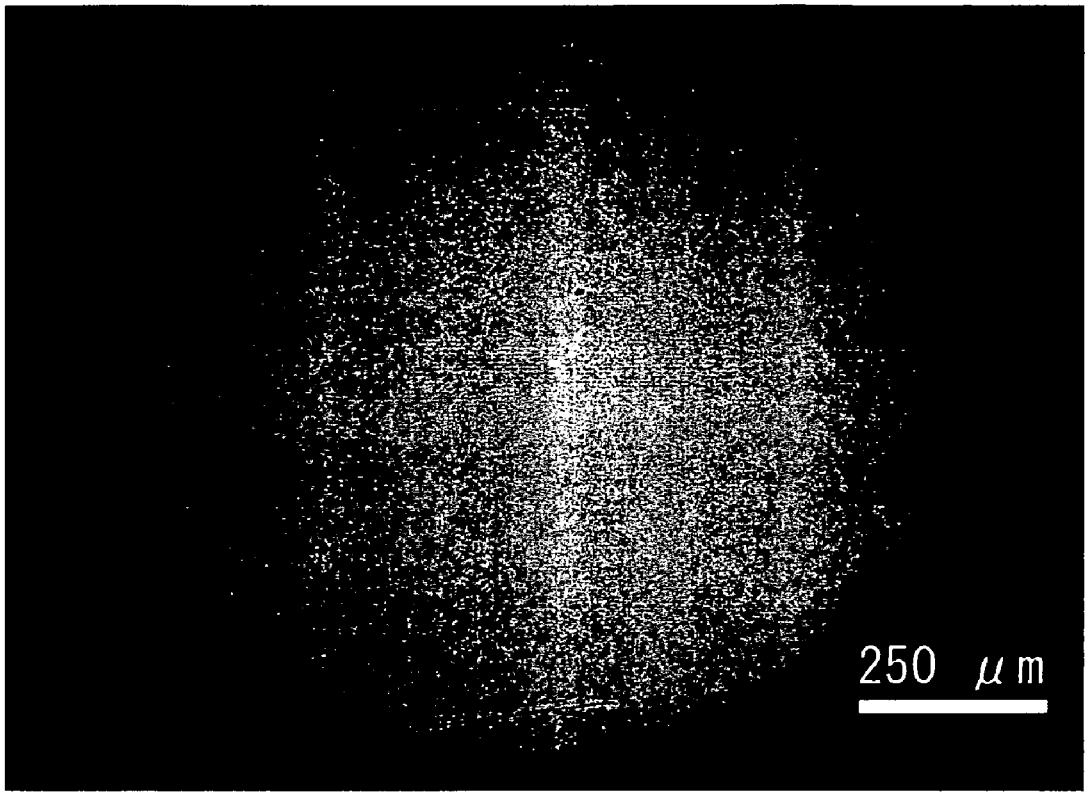
FIG. 1 is an optical micrograph showing the sectional structure of a cast bar obtained in Inventive Example 2.

FIG. 1 is an optical micrograph showing the sectional structure of the cast bar with a diameter of 1.0 mm obtained in Inventive Example 2. As shown in FIG. 1, except for casting defects and polishing marks, no contrast of crystal particles is observed in the optical micrograph. This clearly proves the formation of a metallic glass.

INVENTIVE EXAMPLE 11

$(Co_{0.705}Fe_{0.045}B_{0.15}Si_{0.10})_{96}Nb_4$

INVENTIVE EXAMPLE 12

$(Co_{0.705}Fe_{0.045}B_{0.15}Si_{0.10})_{94}Nb_6$

INVENTIVE EXAMPLE 13

$(Co_{0.705}Fe_{0.045}B_{0.15}Si_{0.10})_{92}Nb_8$

Figure 2:
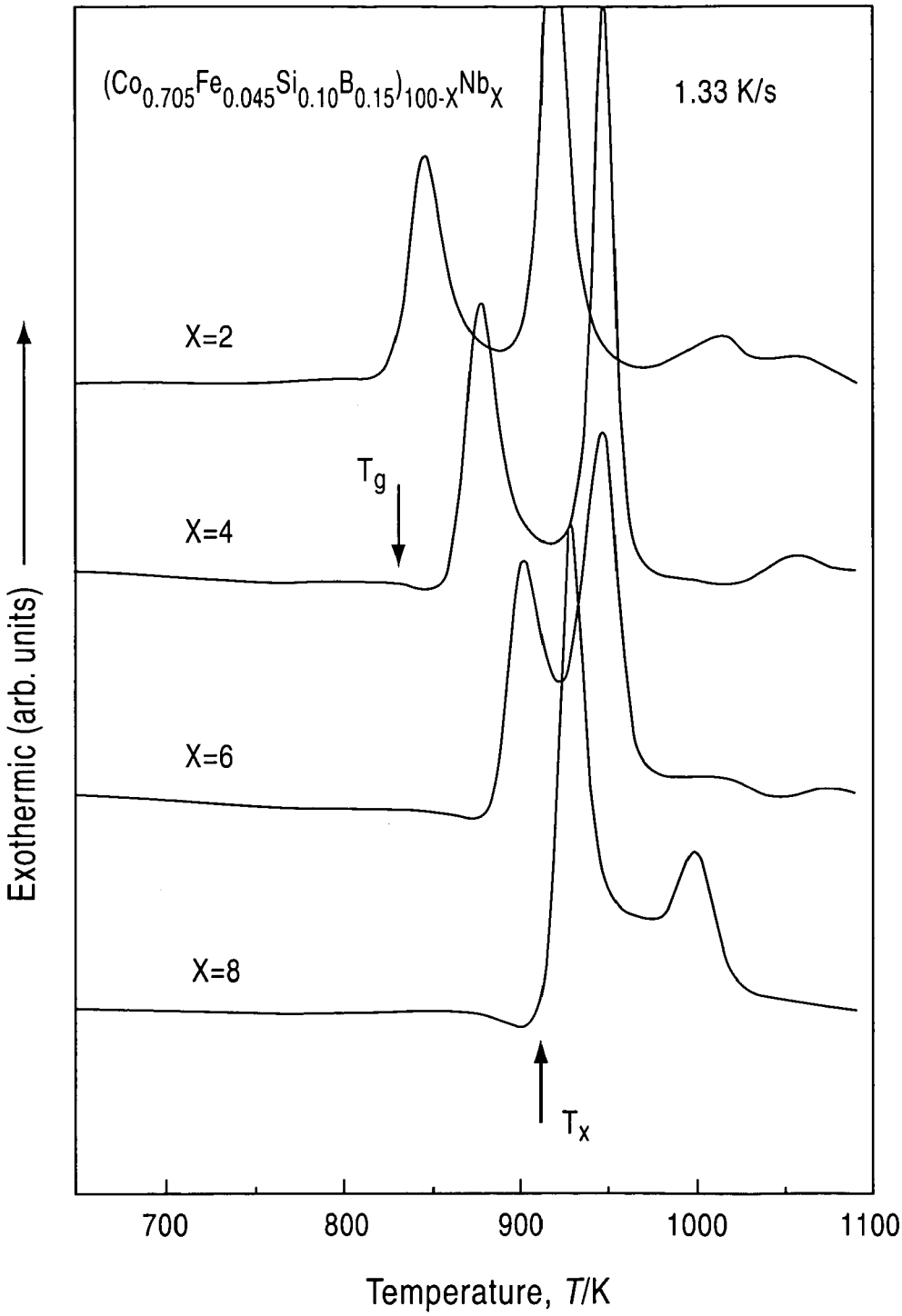
FIG. 2 is a graph showing thermal analysis curves of ribbons obtained in Inventive Examples 10, 11 and 12 and Comparative Example 2.

A molten alloy having each of the above compositions was rapidly solidified through a conventional melt-spinning process to prepare a ribbon material having a thickness of 0.025 mm and a width of 2 mm. FIG. 2 shows thermal analysis curves of the ribbon materials obtained in Inventive Examples 11, 12 and 13 and Comparative Example 2. As seen in FIG. 2, when the content of Nb is in the range of 4 to 8 atomic %, a wide $\Delta T_\chi$ of 40 K or more can be obtained.

Figure 3:
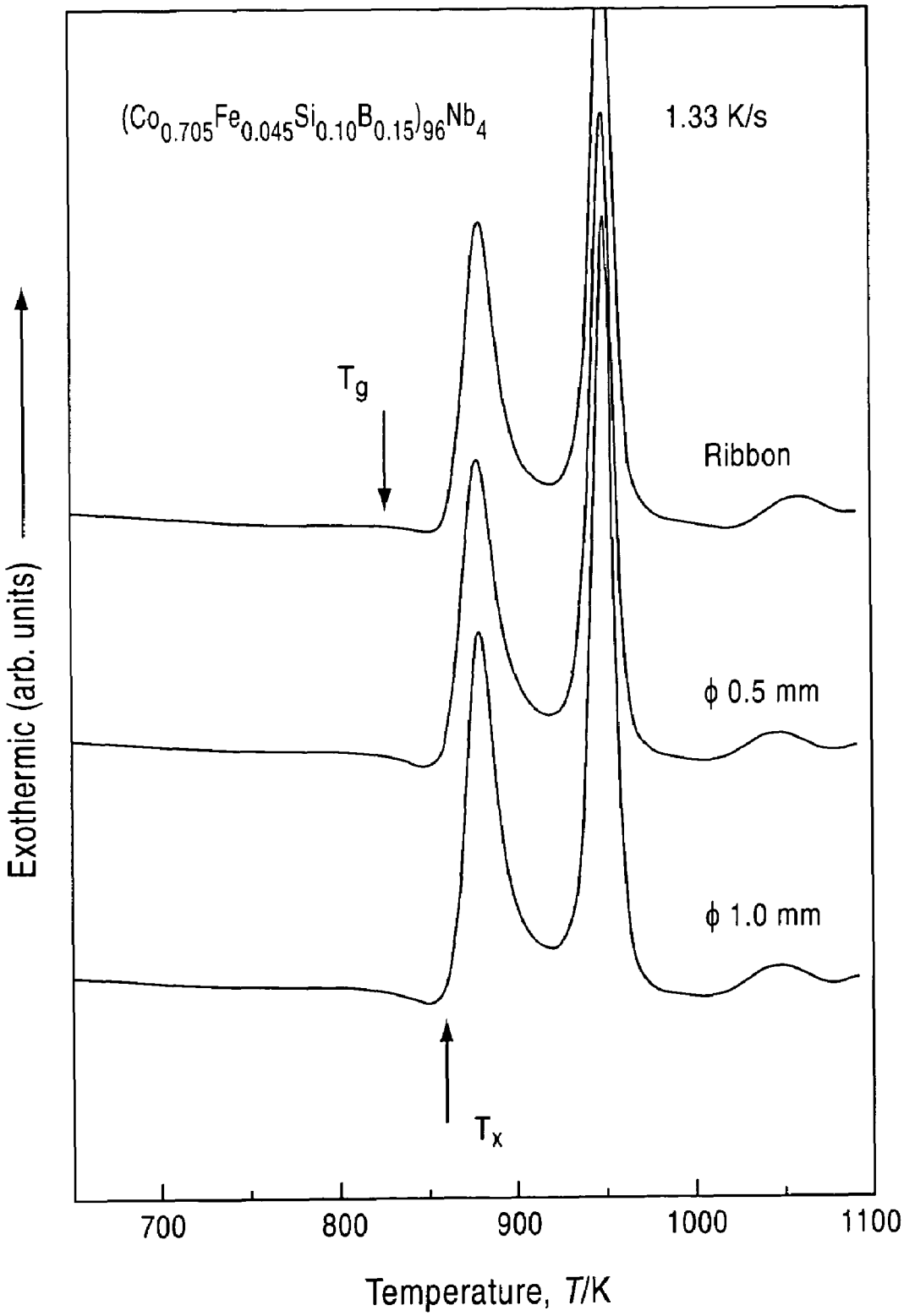
FIG. 3 is a graph showing thermal analysis curves of the cast bar obtained in Inventive Example 2 and the ribbon obtained in Inventive Example 11.

FIG. 3 shows thermal analysis curves of the cast bar obtained in Inventive Example 2, a cast bar having the same composition as that of Inventive Example 2 and a diameter of 0.5 mm, and the ribbon material obtained in Inventive Example 11. As seen in FIG. 3, there is not any difference between the ribbon material and the bulk material.

Figure 4:
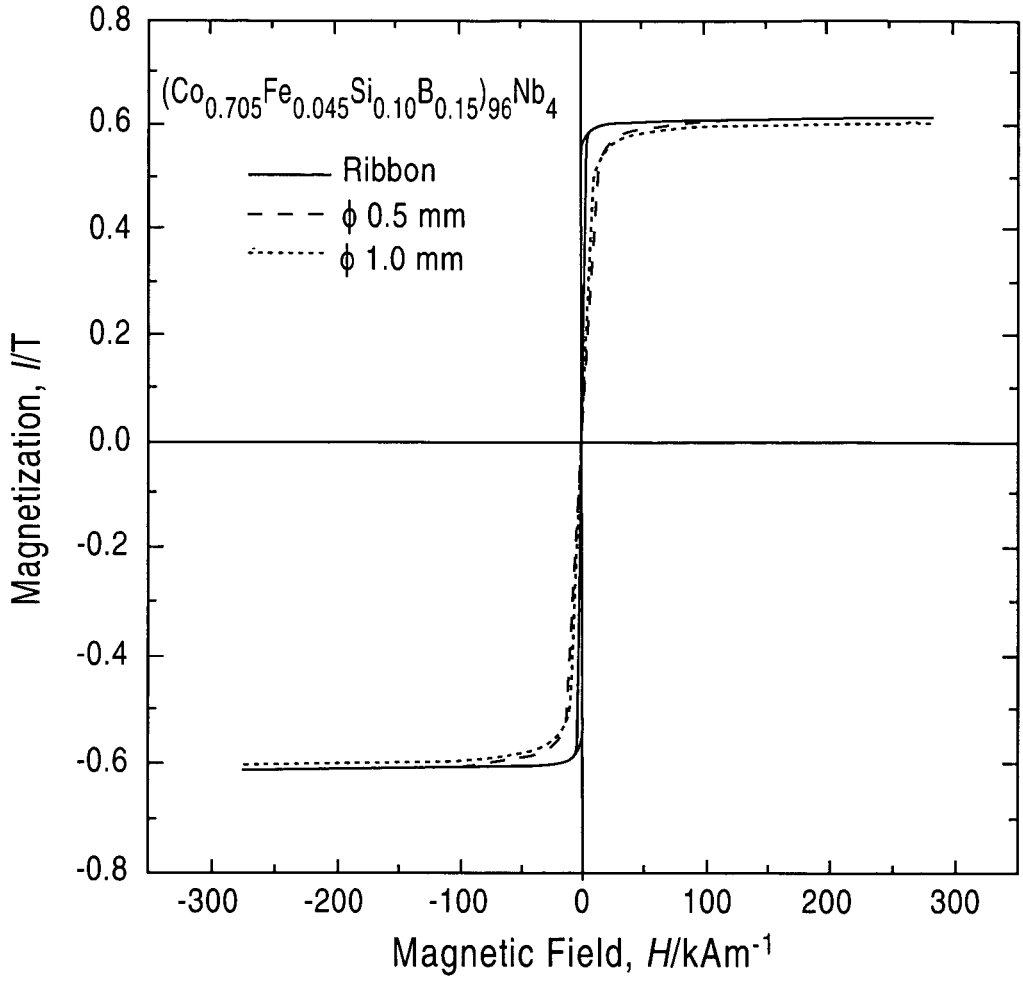
FIG. 4 is a graph showing I-H hysteresis curves of the cast bar obtained in Inventive Example 2 and the ribbon obtained in Inventive Example 11, based on the measurement of their magnetic characteristics using a vibrating-sample magnetometer.

FIG. 4 shows I-H hysteresis curves of the cast bar obtained in Inventive Example 2 and the ribbon obtained in Inventive Example 11, based on the measurement of their magnetic characteristics using a vibrating-sample magnetometer. These curves show that both Inventive Examples 2 and 11 exhibit excellent soft magnetic characteristics.

INDUSTRIAL APPLICABILITY

As mentioned above, the Co-base metallic glass alloy of the present invention has excellent glass forming ability which achieves a critical thickness or diameter of 1.5 mm or more and allows a metallic glass to be obtained through a copper-mold casting process. Thus, the present invention can practically provide a large metallic glass product having excellent soft magnetic characteristics and high saturation magnetization.

What is claimed is:

1. A soft magnetic Co-based metallic glass alloy product with high glass forming ability, comprising metallic glass alloy being represented by the following composition formula:

$$[Co_{1-n-(a+b)}Fe_n\ B_a\ Si_b]_{100-\chi}M_\chi,$$

wherein each of a, b and n represents an atomic ratio satisfying the following relations: $0.1 \leqq a \leqq 0.17$; $0.06 \leqq b \leqq 0.15$; $0.18 \leqq a+b \leqq 0.3$; and $0 \leqq n \leqq 0.08$, M represents one or more elements selected from the group consisting of Zr, Nb, Ta, Hf, Mo, Ti, V, Cr, Pd and W, and $\chi$ satisfies the following relation: 3 atomic $\% \leqq \chi \leqq 10$ atomic %, wherein said glass alloy product has minimum thickness or diameter of 0.5 mm or more, and said metallic glass alloy has a supercooled-liquid temperature interval ($\Delta T_\chi$) of 40 K or more, a reduced glass-transition temperature ($T_g/T_m$) of 0.59 or more and a coercive force of 2.0 A/m or less, said metallic glass alloy being cooled and solidified from its liquid phase in a supercooled liquid state.

2. The soft magnetic Co-based metallic glass alloy product as defined in claim 1, which contains 3 atomic % or less of one or more elements selected from the group consisting of P, C, Ga and Ge.

* * * * *